United States Patent [19]

Blase et al.

[11] 4,350,255

[45] Sep. 21, 1982

[54] TELESCOPING MOBILE CRANE

[75] Inventors: Helmut Blase, Dortmund; Arend Högemann, Witten; Dieter Schulze, Dortmund, all of Fed. Rep. of Germany

[73] Assignee: Harnischfeger GmbH, Fed. Rep. of Germany

[21] Appl. No.: 162,600

[22] Filed: Jun. 24, 1980

[30] Foreign Application Priority Data

Jun. 29, 1979 [DE] Fed. Rep. of Germany ..... 2926292

[51] Int. Cl.[3] ..... B66C 23/06

[52] U.S. Cl. ..... 212/268; 212/184; 52/115

[58] Field of Search ..... 212/267, 268, 264, 230, 212/231, 184, 187; 52/111, 115; 91/167 R; 254/93 R

[56] References Cited

U.S. PATENT DOCUMENTS

| | | | |
|---|---|---|---|
| 3,355,034 | 11/1967 | Nolan et al. | 212/264 |
| 3,749,254 | 7/1973 | Grider | 212/267 |
| 3,841,494 | 10/1974 | Chalupskey et al. | 212/268 |
| 3,921,819 | 11/1975 | Spain | 212/268 |

FOREIGN PATENT DOCUMENTS

| | | |
|---|---|---|
| 44-27626 | 11/1969 | Japan . |
| 49-55048 | 5/1974 | Japan . |

*Primary Examiner*—Robert J. Spar
*Assistant Examiner*—Kenneth Noland
*Attorney, Agent, or Firm*—McGlew and Tuttle

[57] ABSTRACT

A telescopic, mobile crane comprising, a first base member pivotally mounted on a carriage, a second telescopic member telescopically engaged with the first member, an idle or manual member telescopically engaged to the second member and a drive piston and cylinder unit connected between the first and second members for extending the second member from the first member. An arresting apparatus is connected between the piston and cylinder arrangement and the idle member for extending the idle member. When the idle member is extended, the first and second members are locked to each other by a pawl and pin arrangement and the second member is disengaged from the piston and cylinder arrangement. After the idle member is extended, the first and second members are unlocked from each other to permit the extension of the second member.

5 Claims, 11 Drawing Figures

1
2
3
4
5
6
7
9
17
19
20
23
24

TELESCOPING MOBILE CRANE

FIELD AND BACKGROUND OF THE INVENTION

The present invention relates in general to telescoping cranes and, in particular, to a new and useful telescoping mobile crane which facilitates the easy and rapid extension of an idle unpowered telescopic member.

Telescoping cranes are known particularly those types which are mounted to a vehicle. The cranes comprise a base member or part which is directly hinged to a carriage or vehicle, at least one part telescopically engaged with the base part and an idle or manually extendable telescopic part engaged into the first mentioned telescopic part. Power means such as a mechanical drive or piston cylinder arrangement is connected between the base part and the first telescopic part to extend the first telescopic part. Such cranes are difficult to handle if the idle telescoping part is to be extended. To extend this idle part, which is also called a jib insert or manual insert, the following operations are required with a mobile crane having, for example, four telescopic parts:

(a) First, a telescoping part, designated part II in the following, which is directly associated with the idle telescoping part, is immovably coupled to the idle part by a connecting bolt. This part II is moved through about one meter into an extended position until access-hole covers of all the telescope parts are exposed. Upon unscrewing the screws of these covers, the covers are removed.

(b) All jib or telescoping parts are then completely retracted and a locking bolt is replaced to lock a telescoping part I, which is next to part II, to a so-called basic or base part which is hinged directly to the vehicle.

(c) Telescoping part II is extended until the hole for a connecting bolt in the lower portion of the idle telescoping part is aligned with a hole in the basic part.

(d) Whereupon, connecting bolts are engaged through holes into a cantilever extension of a lower cylinder which moves the part, for which purpose special tools are needed.

(e) A so-called locking plate is now fixed in place, to secure the locking bolt. The special tool is removed. Then, telescoping part II, along with the idle telescoping part, are brought into their extended positions.

(f) Next, a connecting bolt is removed and the idle part is disengaged from telescoping part II and connected to the cantilever extension of the lower cylinder.

(g) The jib is then retracted until the front bolt plate of telescoping part II is aligned with the rear bolt hole of the idle part or telescoping part III.

(h) Telescoping parts II and III are connected to each other by means of two bolts.

(i) The bolt on the basic or base part and the special tools are removed.

(j) The so-called locking plate is firmly fixed in place, to prevent it from getting lost.

(k) Then, a locking bolt must be removed. All the covers for access holes are fixed in place again. The jib with the extended idle part is now ready for normal operation.

To retract the idle telescoping part, the following must be done:

(a) The jib is extended until all the covers of the access holes are exposed.

(b) The covers are removed from the holes.

(c) The jib is retracted. Locking bolts and the connecting bolt for telescoping part III are put in place by means of special tools.

(d) The connecting bolt locking telescoping part II to part III is removed. The basic part and telescoping part I are now locked to each other. Telescoping part III is connected to the lower cylinder. Telescoping part II is disengaged from telescoping part III.

(e) The jib is retracted, using the lower cylinder, until the bolt holes in telescoping parts II and III are aligned with each other.

(f) The connecting bolts of telescoping part III are engaged into the other holes.

(g) By means of special tools, one bolt is removed from telescoping part III. Then one locking plate is fixed in place to secure the locking bolt. The special tools are removed.

(h) The drive of the jib is started to retract telescoping parts II and III.

(i) One locking bolt is removed. The jib is now ready for normal operation with the telescoping part III retracted.

(j) All the covers for access holes are fixed in place again.

In practice, the foregoing operations needed for extending and retracting the jib are frequently performed by two operators, and, for example, the extending of the jib or telescoping part of a four-part telescopic crane takes about 20 minutes.

SUMMARY OF THE INVENTION

The invention is directed to a device which performs the operating of extending or retracting the idle telescoping part in a shortest possible time, for example, with the aid of a so-called double cylinder, and which saves manual operations by a partial automation.

In contradistinction to the prior art telescopic cranes, particularly in mobile cranes, the inventive telescopic crane comprising for example, a four-part jib, can be extended by the idle telescoping part within a relatively short period of time of two minutes, for example. Such an operation can be performed by a single person, so that the operational costs of the inventive telescopic crane may considerably be reduced as compared to the prior art.

Accordingly, an object of the present invention is to provide a telescopic crane comprising, a first member, a second member telescoptically engaged with the first member, an idle or manual member telescopically engaged with the second member, drive means connected to the first member and operatively connected to the second member for extending the second member, arresting means between the drive means and the idle member for establishing engagement between the drive means and the idle member to extend the idle member, and locking means between the first and second members for establishing engagement between the first and second members to restrain the second member from being extended by the drive means when the drive means is activated to extend the idle member. The drive means may comprise a piston rod and cylinder arrangement.

In another embodiment of the invention, the idle telescoping part can be coupled to the piston rod or cylinder extension in a simple way, without difficult handling, with the oblong slots permitting a quick coupling by means of a spring-loaded bolt.

The provision of a pivoting handle according to another embodiment makes it possible to actuate the spring loaded bolt easily, and two definite positions may be predetermined for the bolt, which are clearly indicated by the position of the handle. One position indicates the locking engagement of the bolt, the diametrically opposite position of the handle indicates a disengagement.

A further object of the present invention is to provide a telescopic crane, particularly a mobile crane, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF PREFERRED EMBODIMENT

The invention is shown as applied to a mobile, four-part telescopic crane. Such a crane may be mounted on any undercarriage of a vehicle for example, so that, to simplify the drawings, no such undercarriage is shown.

Figure 3:
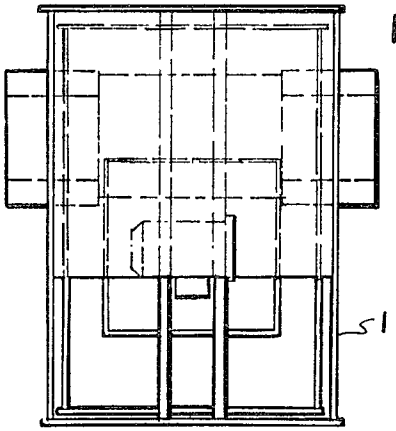
FIG. 3 is a view in the direction of arrow A of FIG. 1.
Figure 6:
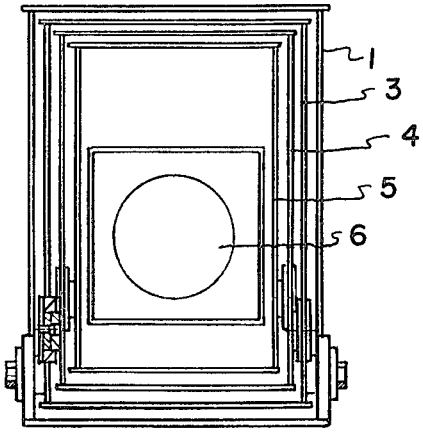
FIG. 6 is a sectional view taken along the line VI—VI of FIG. 4.
Figure 8:
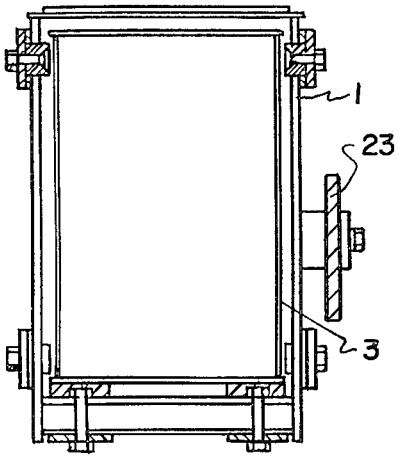
FIG. 8 is a sectional view of the telescopic jib in the area of the pawl.

A so-called basic part or base member 1 of the jib is hinged to a vehicle or the like (not shown) at a fixed location 2. This basic part is successively engaged in a telescopic manner with telescoping parts 3, 4 and 5. As may be learned particularly from FIGS. 3,6,8, all the telescopic parts 1 and 3 to 5 have a rectangular cross-section. If needed, however, other cross-sections may be provided.

Telescoping part 5 is frequently referred to as an idle, manual, or jig insert, since it is not equipped with any mechanical drive of its own for extension or retraction.

Figure 2:
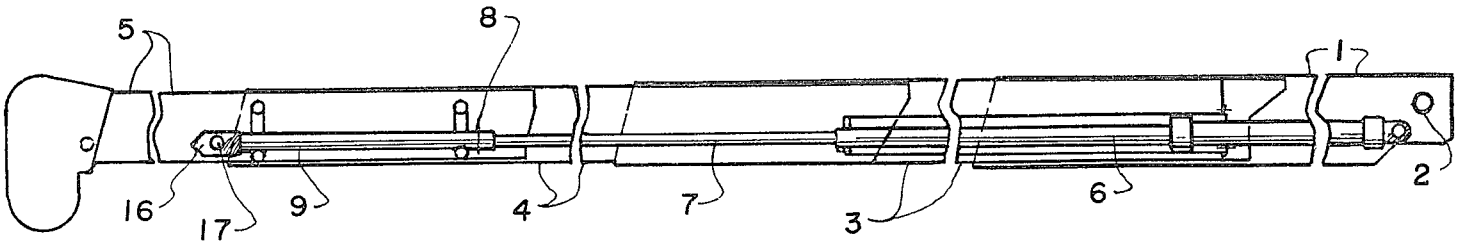
FIG. 2 shows the jib of FIG. 1 with all four parts in extended positions, also in a longitudinal sectional view.

In the space formed by basic part 1 and telescoping parts 3 to 5, a piston and cylinder unit 6, referred to in the following as double cylinder, extends coaxially with or parallel to the longitudinal axis of the jib comprising all of the telescopic parts. The double cylinder 6 is supplied (not shown) with a pressure fluid, particularly hydraulic liquid. Its first stage is operatively coupled to telescoping part 3 and its second stage is operatively coupled to telescoping part 4, with its base connected to base member 1. In the embodiment shown, piston rod 7 is coupled, in the direction of idle telescoping part 5, through a hinge 8 to an extension 9 which extends coaxially of double cylinder 6 (FIG. 2). Extension 9 is equipped with a plurality of spaced-apart braces, of which only 2 indicated at 10 and 11 are shown and which are fixed to extension 9. Each brace carries two spaced-apart backing rollers 12 and 13 on either of their diametrically opposite ends (FIG. 4), which rollers are mounted for rolling on the inner surfaces of idle telescoping part 5, so as to improve the loading conditions of extension 9, particularly its resistance to buckling. With part 4 connected to part 5 by bolt 17 and pawl 23 (FIGS. 4, 5) cylinder 6 acts on part 4 through bolt or pin 17 when part 5 is retracted.

At the free end of double cylinder 6, extension 9 is provided with an eye 15 whose axis extends perpendicularly to the axis of extension 9 and parallel to the axes of rotation of rollers 12 and 13. The eye is provided in an enlarged or coupling portion 16 of extension 9 and intended for a connecting bolt 17 to be passed therethrough.

Figure 4:
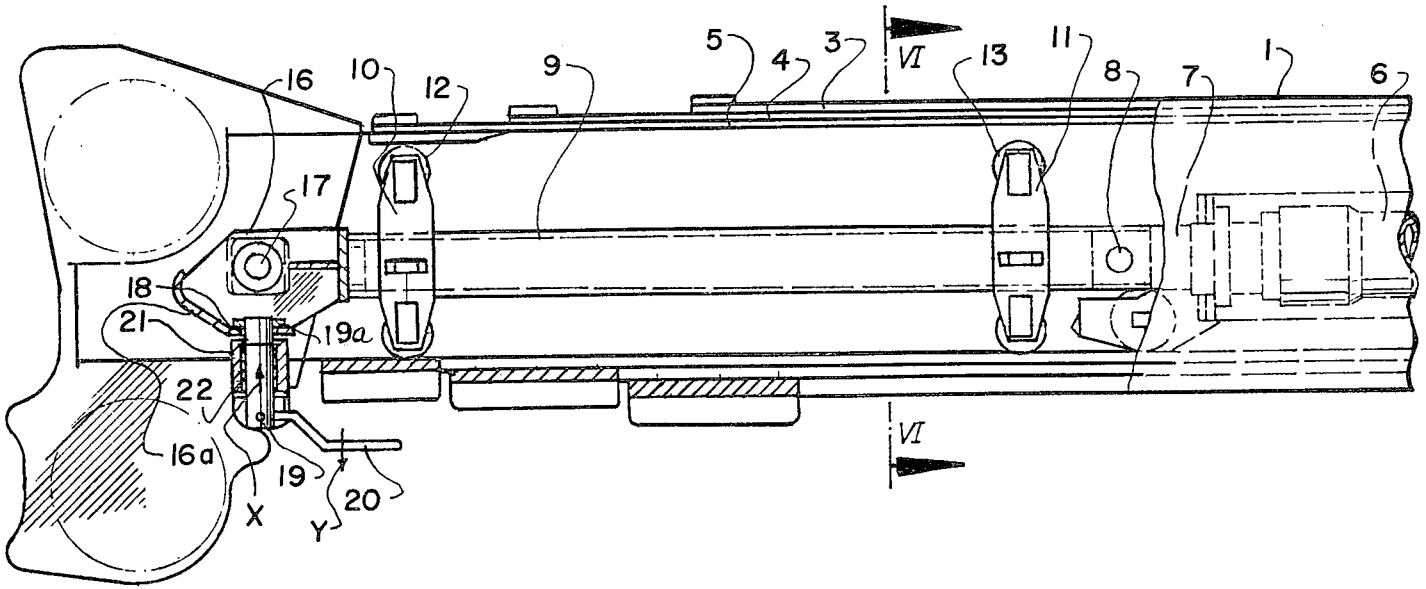
FIG. 4 is an enlarged partial view corresponding to FIG. 1.
Figure 5:
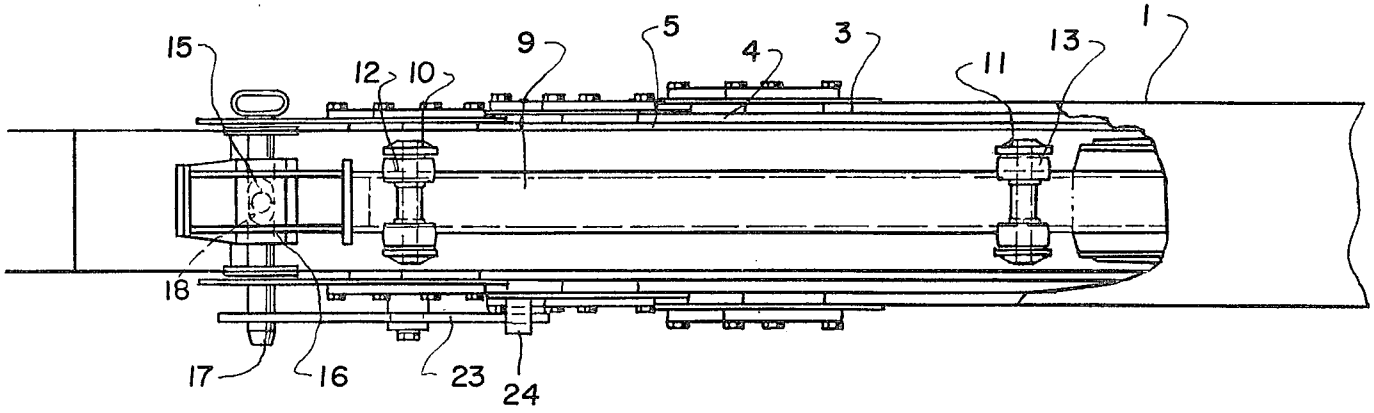
FIG. 5 is a top plan view partly in section corresponding to FIG. 4.

As best seen in FIG. 4, extension 9 or enlarged portion 16 thereof, comprises a portion with an oblong slot 18 for receiving a spring loaded bolt 19. In the embodiment shown, bolt 19 is provided with a handle 20 which may be operatively connected thereto or is integral therewith. To secure it against becoming lost from telescoping part 5, to which it is mounted, bolt 19 is received in a sleeve 21 in which a spring element 22 urges the bolt in the direction X, so that as soon as the respective parts are in a position of alignment, bolt 19 snaps into oblong slot 18 by riding down incline 16*a*. That is, when idle telescoping part 5 is retracted (into its position as seen in FIG. 4) the top end of pin 19 engages surface 16*a* and moves down until pin 19 engages with slot 18 at which point pin 19 snaps into slot 18. To disengage this coupling of parts 5 and 9, bolt 19 is moved by means of handle 20 against the spring force of element 22, in the direction Y, and turned for example, through 180°, relative to its position shown in FIG. 4. In this position, bolt 19 cannot move in the direction X, which is ensured by suitable stops. This is because pin 19 has a top key part 19*a* which can pass into slot 18 only when pin 19 is in the unrotated position of FIG. 4.

Figure 1:
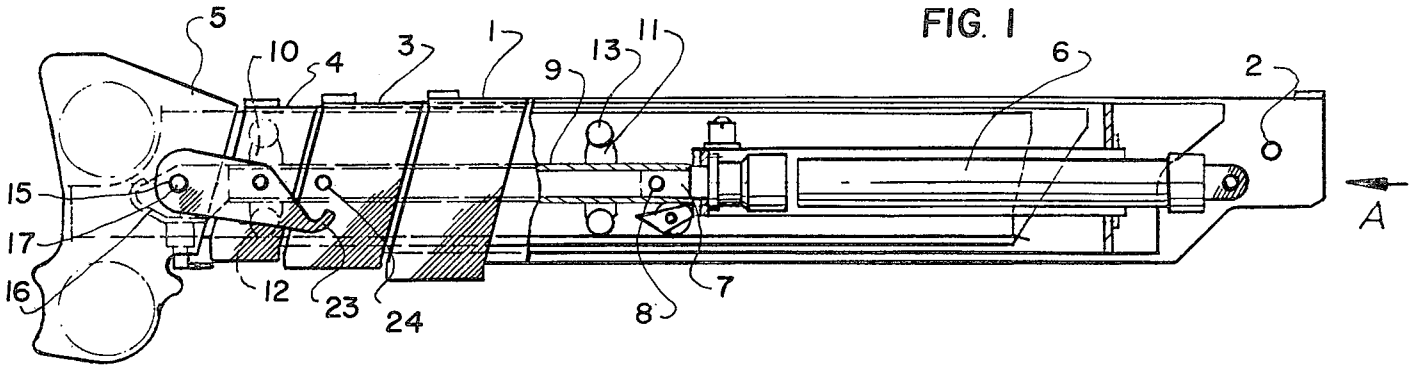
FIG. 1 is a side elevational view partly in section of a four-part telescopic jib in a retracted position.
Figure 7:
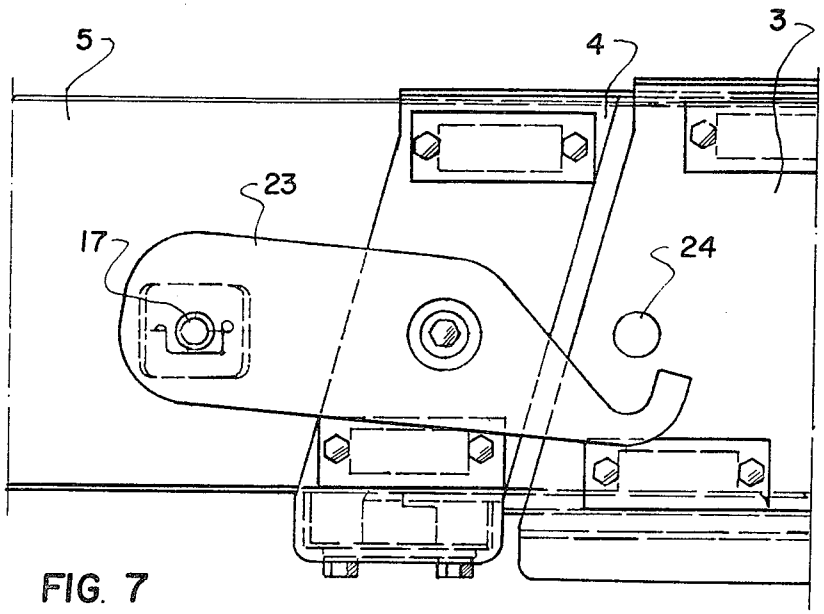
FIG. 7 is an enlarged partial view showing the position of the pawl, with the idle telescoping part being in extended position.

Telescoping part 4 carries a pivotal pawl 23 which can be brought into locking engagement with an arresting element or post 24, for example a stud, fixed to telescoping part 3 (FIGS. 1 and 7). Conversely, a pawl may be pivoted to telescoping part 3 and a stud fixed to telescoping part 4. Even a plurality of such pawls 23 may be provided, for example, on diametrically opposite sides.

To bring idle telescoping part 5 of a four-part telescopic crane into its operating position (see FIG. 11), the following operations are necessary:

The first stage of double cylinder 6 associated with telescoping part 3 is extended. Bolt 17 connecting telescoping part 4 to idle telescoping part 5 and to extension 9 is removed (FIGS. 9 and 10).

Telescoping parts 3 and 4 are locked to each other by pawl 23, (which is which bolt 17, can engage element 24) to prevent telescoping part 4 from being pushed out of telescoping part 3.

With spring loaded pin 19 being engaged into slot 18 of extension 9, the second stage of double cylinder 6 is extended up to the end of its stroke.

Figures 9, 10, 11:
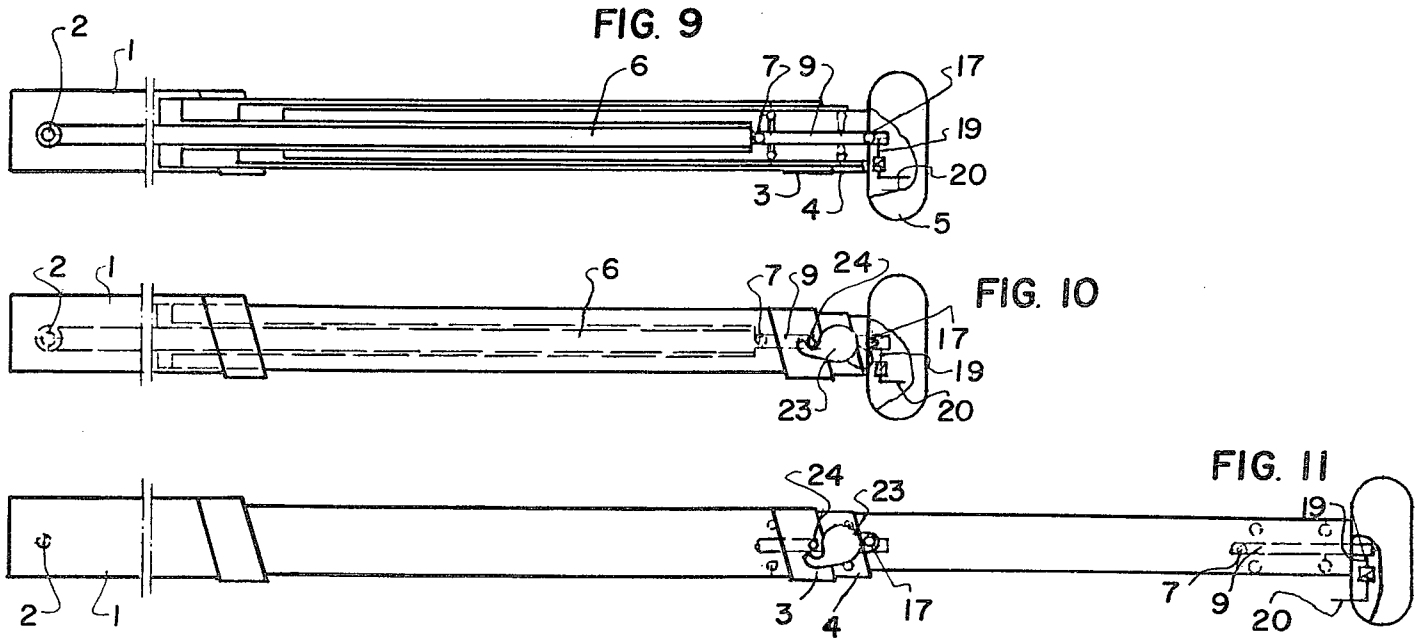
FIG. 9 is a diagrammatical partial longitudinal section of the jib in the retracted position shown in FIG. 1.
FIG. 10 is a side elevational view corresponding to FIG. 9 with the pawl pivoted into locking position.
FIG. 11 shows the jib of FIGS. 9 and 10 with the idle part in extended and arrested position.

Upon pulling spring loaded pin 19 by means of handle 20 in the direction Y and swinging handle 20 through 180° relative to its position shown in FIGS. 4, 9 and 10, into its unlocking position, extension 9 can be returned toward part 4 where is is reconnected therewith by bolt 17 and then telescoping part 4 can be extended by correspondingly supplying pressure fluid into double cylinder 6 to again extend piston 7. Bolt 17 also extends through idle part 5 in its extended position as shown in FIGS. 2 and 7, to retain it in extended position. The crane is now ready for operation.

To retract telescoping part 5, the following operations are needed:

Telescoping part 4, if extended, is retracted by means of the second stage of double cylinder 6. Bolt 17 connecting telescoping parts 4, 5 and double cylinder 6 is removed. Extension 9 is now freely movable within telescoping part 5 and is extended, until oblong slot 18 of extension 9 engages with spring loaded bolt 19 which has been brought into its position for locking. Double cylinder 6 is then supplied with pressure fluid to retract it up to the stop. Telescoping part 5 is thereby taken along.

Spring loaded bolt 19 is then disengaged again and connecting bolt 17 is passed through telescoping parts 4 and 5 and extension 9.

Thereupon, idle telescoping part is retracted and telescoping parts 3 and 4 of the jib are ready for operation.

The inventive features set forth in the specification and claims and shown in the drawings may be applied individually or in any combination.

While a specific embodiment of the invention has been shown and described in detail to illustrate the application of the principles of the invention, it will be understood that the invention may be embodied otherwise without departing from such principles.

What is claimed is:

1. A telescopic crane comprising:

a first member;

a second member telescopically engaged with said first member;

an idle member telescopically engaged with said second member;

drive means connected to said first member and operatively connected to said second member for extending said second member;

arresting means between said drive means and said idle member for establishing engagement between said drive means and said idle member to extend said idle member;

locking means between said first and second members for establishing engagement between said first and second members to restrain movement of said second member when said drive means extends into said idle member;

said drive means comprising a single piston cylinder arrangement, and including a pin interconnecting one end of said piston cylinder arrangement to said second member and to said idle member when said idle member is in a retracted position, said pin engaged with said idle member when said idle member is in an extended position also;

said arresting means comprising an extension connected to said single piston cylinder arrangement, extending outwardly from said first member for receiving said pin and interconnecting said second member and said idle member to said extension;

a spring loaded bolt connected to one of said idle member and said extension, the other of said idle member and said extension including an oblong slot for receiving said spring loaded bolt to engage said drive means to said idle member; and a base member pivotally mounted to a carriage and telescopically receiving said first member;

said piston cylinder arrangement comprising a double piston and cylinder arrangement having a first stage connected to said first member and a second stage operatively connected to said second member, with a base stage connected to said base member.

2. A telescopic crane according to claim 1, including a handle connected to said spring loaded bolt which is pivotally mounted to bring said spring loaded bolt into an unlocked position which is free of said oblong slot.

3. A telescopic crane according to claim 1, wherein said locking means comprises a pawl pivotally mounted to one of said first and second members and a post connected to the other of said first and second members engageable with said pivotally mounted pawl to engage said first and second members to each other.

4. A telescopic crane according to claim 1, including at least two brackets connected to said extension having rollers at the ends thereof rollable within a space defined by said idle member.

5. A telescopic crane comprising:

a base member (1) adapted to be pivotally connected to a carriage;

a first telescopic member (3) telescopically engaged with said base member;

a second telescopic member (4) telescopically engaged with said first telescopic member;

an idle member (5) telescopically engaged with said second member;

a single double-stage piston cylinder arrangement having a base stage connected to said base member, a first stage connected to said first member and a second stage operatively connected to said second member in a retracted and extended position of said second member;

an extension connected to said second stage including an end portion with an opening therethrough;

a pin (17) engageable with said end portion opening, said pin engageable with said second and idle members when said second and idle members are retracted and when said second stage is retracted, said pin engageable with said second and idle members when said idle member is extended and said second member and second stage are retracted;

a pawl (23) rotatably mounted to said second member having an opening for receiving said pin and rotatable into a locking position with said pin not engaged with said pawl opening;

a post (24) connected to said first member and engageable by said pawl for locking said first and second members together with said pin unengaged with said pawl opening; and a spring loaded bolt (19) connected to said idle member, said end portion having a second opening for receiving said pin to engage said extension to said idle member, said spring-loaded bolt being disengageable from said end portion second opening for disengaging said idle member from said extension.

* * * * *